US010222725B1

(12) United States Patent
Tanaka et al.

(10) Patent No.: US 10,222,725 B1
(45) Date of Patent: Mar. 5, 2019

(54) IMAGE FORMING APPARATUS WITH REMOVABLE-BODY RECEIVABLE MEMBER AND RECLAIM CONTAINER MEMBER

(71) Applicant: FUJI XEROX CO., LTD., Tokyo (JP)

(72) Inventors: Yoshinori Tanaka, Kanagawa (JP); Kiyohito Horii, Kanagawa (JP)

(73) Assignee: FUJIO XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/915,664

(22) Filed: Mar. 8, 2018

(30) Foreign Application Priority Data

Sep. 4, 2017 (JP) ..... 2017-169179

(51) Int. Cl.
*G03G 15/08* (2006.01)

(52) U.S. Cl.
CPC . *G03G 15/0896* (2013.01); *G03G 2215/0692* (2013.01); *G03G 2221/0005* (2013.01)

(58) Field of Classification Search
CPC ..... G03G 15/0896; G03G 2215/0692; G03G 2221/0005
See application file for complete search history.

(56) References Cited

U.S. PATENT DOCUMENTS 5,710,960 A * 1/1998 Hart ..... G03G 21/105 399/253
6,018,637 A * 1/2000 Huss ..... G03G 21/12 220/361
9,170,528 B2 * 10/2015 Torimoto ..... G03G 15/0865
2009/0185824 A1 * 7/2009 Murakami ..... G03G 15/0896 399/120
2011/0085825 A1 * 4/2011 Murase ..... G03G 15/0872 399/260
2011/0182613 A1 * 7/2011 Kamimura ..... G03G 15/0896 399/110
2015/0063877 A1 * 3/2015 Torimoto ..... G03G 15/0865 399/262
2015/0338775 A1 * 11/2015 Hosokawa ..... G03G 15/0868 399/258

FOREIGN PATENT DOCUMENTS

JP 2012-230343 A 11/2012

* cited by examiner

*Primary Examiner* — Francis C Gray
(74) *Attorney, Agent, or Firm* — Sughrue Mion, PLLC

(57) ABSTRACT

An image forming apparatus includes a removable-body receivable member and a container member. The removable-body receivable member removably supports a removable body containing a developer. The removable-body receivable member has an opening at a near portion in an insertion/removal direction in which the removable body is inserted into or removed from the removable-body receivable member. The container member is connected to the opening to contain the developer.

13 Claims, 12 Drawing Sheets

IMAGE FORMING APPARATUS WITH REMOVABLE-BODY RECEIVABLE MEMBER AND RECLAIM CONTAINER MEMBER

CROSS-REFERENCE TO RELATED APPLICATIONS

This application is based on and claims priority under 35 USC 119 from Japanese Patent Application No. 2017-169179 filed Sep. 4, 2017.

BACKGROUND

Technical Field

The present invention relates to an image forming apparatus.

SUMMARY

According to an aspect of the invention, an image forming apparatus includes a removable-body receivable member and a container member. The removable-body receivable member removably supports a removable body containing a developer. The removable-body receivable member has an opening at a near portion in an insertion/removal direction in which the removable body is inserted into or removed from the removable-body receivable member. The container member is connected to the opening to contain the developer.

BRIEF DESCRIPTION OF THE DRAWINGS

Exemplary embodiments of the present invention will be described in detail based on the following figures, wherein.

DETAILED DESCRIPTION

Now, the present invention is described below in detail with reference to the drawings using exemplary embodiments and specific examples. The present invention, however, is not limited to these exemplary embodiments and the specific examples.

In the description with reference to the drawings below, it should be noted that the drawings are schematic and include ratios of dimensions different from the actual ones. For ease of understanding, components not included in the description are appropriately omitted from the drawings.

For ease of understanding the following description, the front-rear direction is represented as an X-axis direction, the left-right direction is represented as a Y-axis direction, and the vertical direction is represented as a Z-axis direction throughout the drawings.

Figure 1:
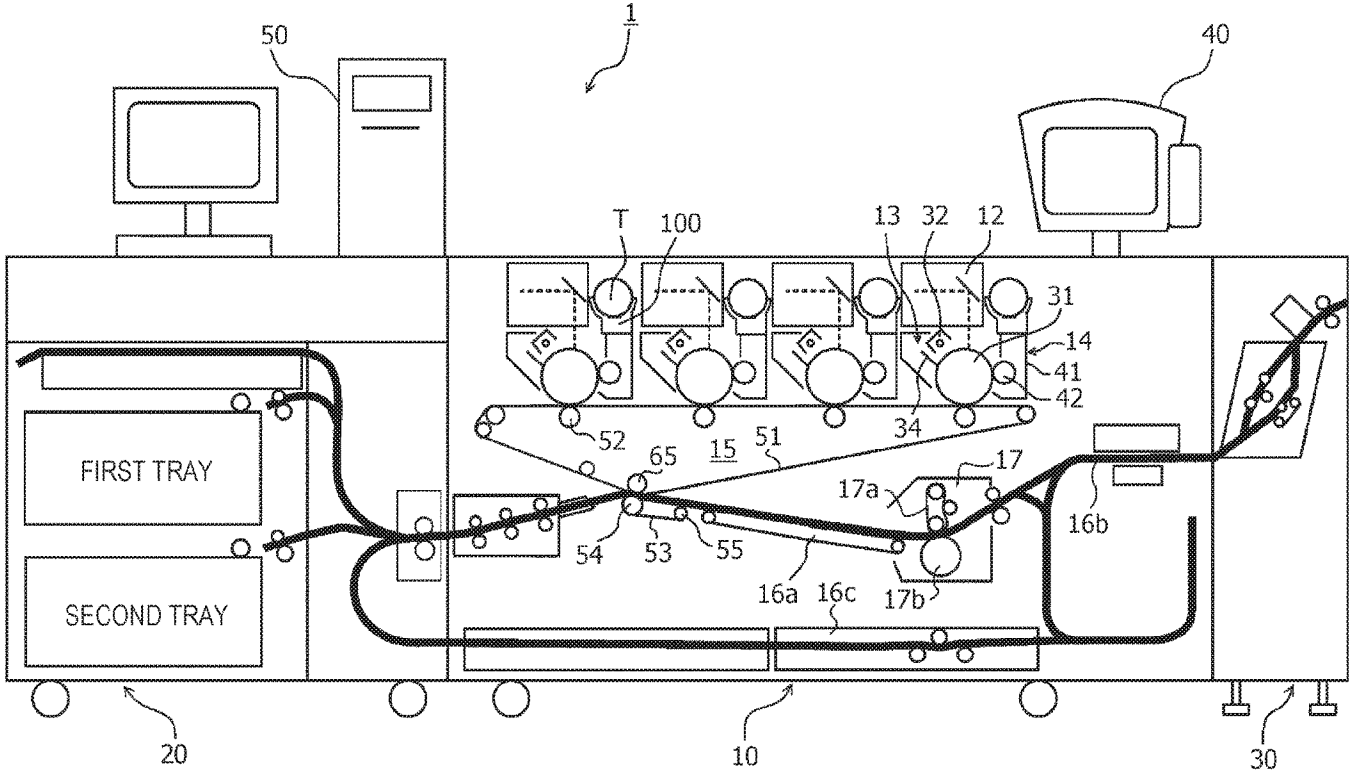
FIG. 1 is a sectional schematic diagram of an example of a schematic structure of an image forming apparatus.

First Exemplary Embodiment (1) Entire Structure and Operation of Image Forming Apparatus (1.1) Entire Structure of Image Forming Apparatus FIG. 1 is a sectional schematic diagram of an example of a schematic structure of an image forming apparatus 1 according to the present exemplary embodiment.

The image forming apparatus 1 includes an image forming unit 10, a sheet feeder 20 attached to one end of the image forming unit 10, a sheet discharge unit 30 disposed at the other end of the image forming unit 10 to receive printed sheets discharged thereto, an operation display 40, and an image processor 50, which generates image information from printing information transmitted from an upstream device.

The image forming unit 10 includes a system controller (not illustrated), exposure devices 12, photoconductor units 13, developing devices 14, a transfer device 15, sheet transport devices 16*a*, 16*b*, and 16*c*, a fixing device 17, and a driving device (not illustrated). The image forming unit 10 forms image information received from the image processor 50 into a toner image on a sheet P fed from the sheet feeder 20.

The sheet feeder 20 feeds sheets to the image forming unit 10. Specifically, the sheet feeder 20 includes multiple sheet trays that contain sheets P of different types (different in, for example, material, thickness, sheet size, or paper grain). The sheet feeder 20 feeds sheets P from any one of these sheet trays to the image forming unit 10.

The sheet discharge unit 30 discharges sheets P on which images have been output by the image forming unit 10. The sheet discharge unit 30 thus includes a discharged sheet receiver that receives the sheets P on which images have been output. The sheet discharge unit 30 may have a post processing function, such as cutting or stapling a stack of sheets discharged from the image forming unit 10.

The operation display 40 is used to input various settings or commands or to display information. Specifically, the operation display 40 corresponds to a so-called user interface, and specifically includes a combination of components such as a liquid crystal display panel, various operation buttons, and a touch screen.

(1.2) Structure and Operation of Image Forming Unit

In the image forming apparatus 1 having the above structure, a sheet from a sheet tray of the sheet feeder 20, which is specified for each print sheet in a print job, is fed to the image forming unit 10 at an image formation timing.

The photoconductor units 13 are arranged side by side below the exposure devices 12, and each include a photoconductor drum 31, serving as an image carrier that rotates. In a rotation direction of each photoconductor drum 31, a charging device 32, the corresponding exposure device 12, the corresponding developing device 14, a first transfer roller 52, and a cleaning blade 34 are arranged.

Each developing device 14 includes a development housing 41, which contains a developer G. The development housing 41 houses a development roller 42, which is disposed opposite the corresponding photoconductor drum 31. A trimmer (not illustrated) that restricts the thickness of the developer G is disposed adjacent to the development roller 42.

The developing devices 14 have the same structure except for the developers G contained in their development housings 41, for forming toner images of yellow (Y), magenta (M), cyan (C), and black (K).

A toner cartridge T and a toner cartridge guide 100 are disposed above each developing device 14. The toner cartridge T is an example of a replaceable, removable body that contains the developer G (toner containing a carrier). The toner cartridge guide 100 guides insertion and removal of the toner cartridge T and allows the toner cartridge T to feed the developer G to the developing device 14 therethrough.

While rotating, each photoconductor drum 31 has its surface charged by the charging device 32 to have an electrostatic latent image formed thereon by latent image forming light emitted from the corresponding exposure device 12. The electrostatic latent image formed on the photoconductor drum 31 is developed by the development roller 42 into a toner image.

The transfer device 15 includes an intermediate transfer belt 51, first transfer rollers 52, and a second transfer belt 53. The intermediate transfer belt 51 is an endless member to which different-colored toner images formed by the photoconductor drums 31 of the respective photoconductor units 13 are transferred in a superposed manner. The first transfer rollers 52 sequentially transfer (first-transfer) the different-colored toner images formed by the respective photoconductor units 13 to the intermediate transfer belt 51. The second transfer belt 53 collectively transfers (second-transfers) the different-colored toner images transferred to the intermediate transfer belt 51 in a superposed manner to a sheet, serving as a recording medium.

The second transfer belt 53 is stretched around a second transfer roller 54 and a separation roller 55. The second transfer roller 54 and a back-up roller 65 disposed on the back surface of the intermediate transfer belt 51 hold a portion between themselves to form a second transfer portion (TR).

A colored toner image formed on the photoconductor drum 31 of each photoconductor unit 13 is sequentially electrostatically transferred (first-transferred) onto the intermediate transfer belt 51 by the corresponding first transfer roller 52 to which a device such as a power source (not illustrated) controlled by the system controller applies a predetermined transfer voltage. Thus, a superposed toner image including superposed different-colored toner is formed.

The superposed toner image on the intermediate transfer belt 51 is transported to a second transfer portion at which the second transfer belt 53 is disposed, with the movement of the intermediate transfer belt 51. At the timing when the superposed toner image is transported to the second transfer portion, a sheet P is fed from the sheet feeder 20 to the second transfer portion. Then, a predetermined transfer voltage is applied from a device, such as a power source, controlled by the system controller, to the back-up roller 65 opposing the second transfer roller 54 with the second transfer belt 53 interposed therebetween. Thus, the superposed toner image on the intermediate transfer belt 51 is collectively transferred to the sheet P.

Toner remaining on the surface of each photoconductor drum 31 is removed by the corresponding cleaning blade 34 and recovered into a waste toner receiver (not illustrated). Each photoconductor drum 31 has its surface recharged by the corresponding charging device 32.

The fixing device 17 includes an endless fixing belt 17*a*, which rotates in one direction, and a pressing roller 17*b*, which is in contact in the peripheral surface of the fixing belt 17*a* and rotates in one direction. An area in which the fixing belt 17*a* and the pressing roller 17*b* are pressed against each other forms a nip (fixing area).

The sheet P to which the toner images have been transferred by the transfer device 15 is transported to the fixing device 17 through the sheet transport device 16*a* while having the toner image unfixed. The sheet P transported to the fixing device 17 has its toner image fixed by the paired fixing belt 17*a* and pressing roller 17*b* with the effects of the pressure contact and heating.

The sheet P subjected to fixing is transported to the sheet discharge unit 30 through the sheet transport device 16*b*.

To output images on both surfaces of a sheet P, the sheet transport device 16*c* reverses the sheet P, and feeds the sheet P again to the second transfer portion of the image forming unit 10. After the toner image is transferred to the sheet P and the transferred image is fixed to the sheet P, the sheet P is fed to the sheet discharge unit 30. The sheet P fed to the sheet discharge unit 30 undergoes postprocessing as needed, such as cutting or stapling, and is discharged to the discharged sheet receiver.

(2) Structure of Related Portion

Figure 2:
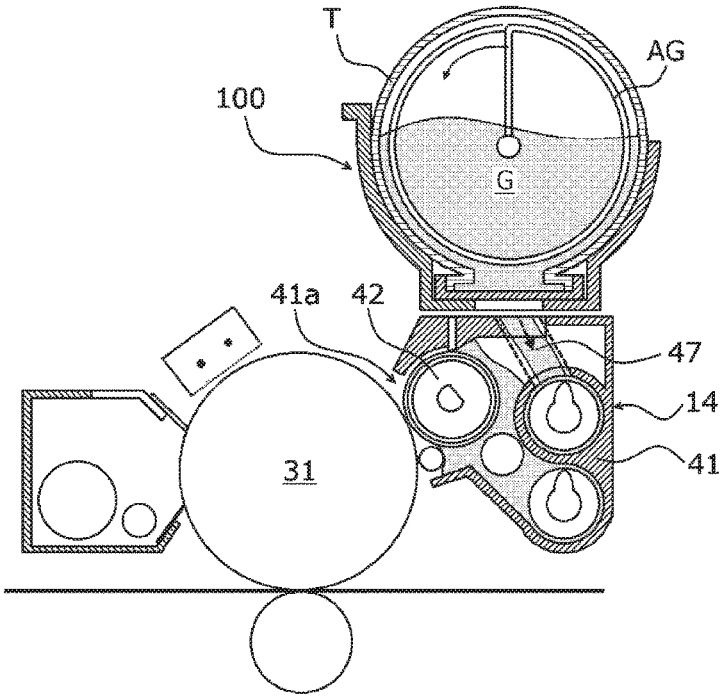
FIG. 2 is a vertical-sectional schematic diagram of a photoconductor unit, a developing device, and a toner cartridge.
Figure 3:
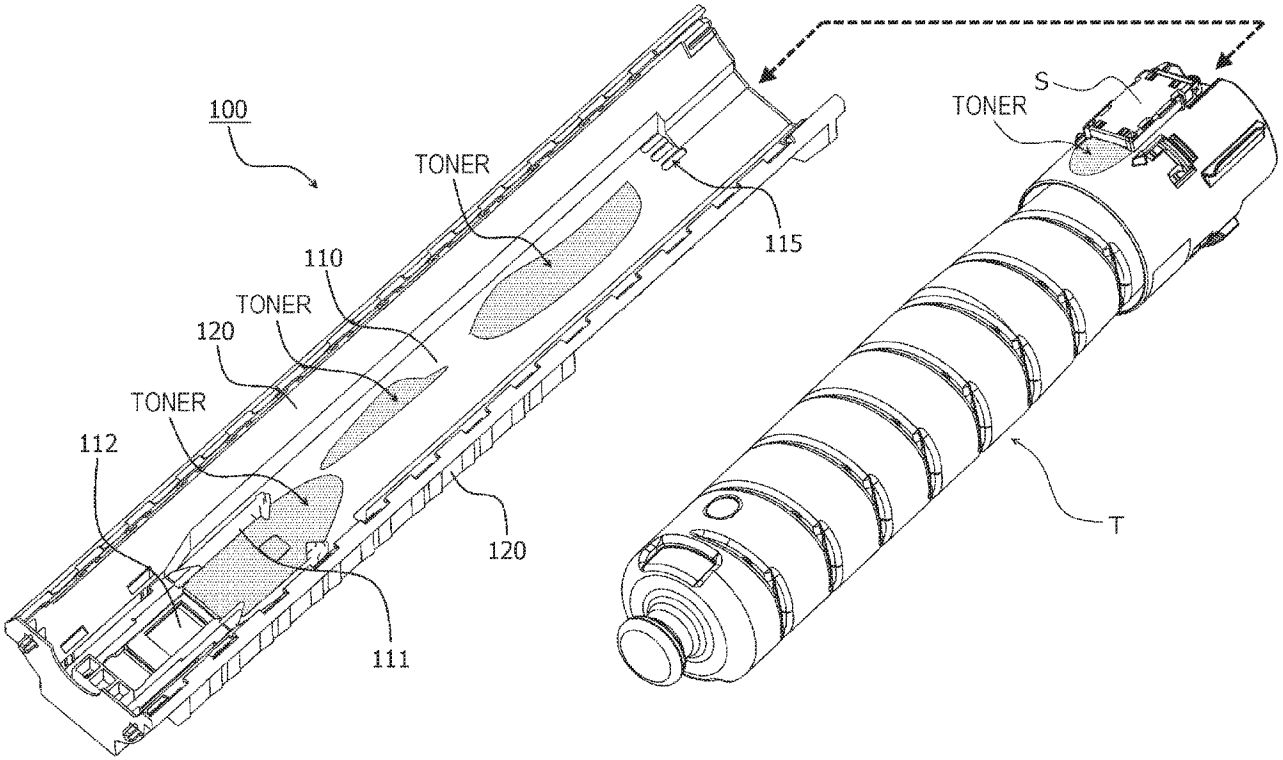
FIG. 3 is a perspective view of insertion or removal of a toner cartridge into or from a toner cartridge guide.
Figure 4:
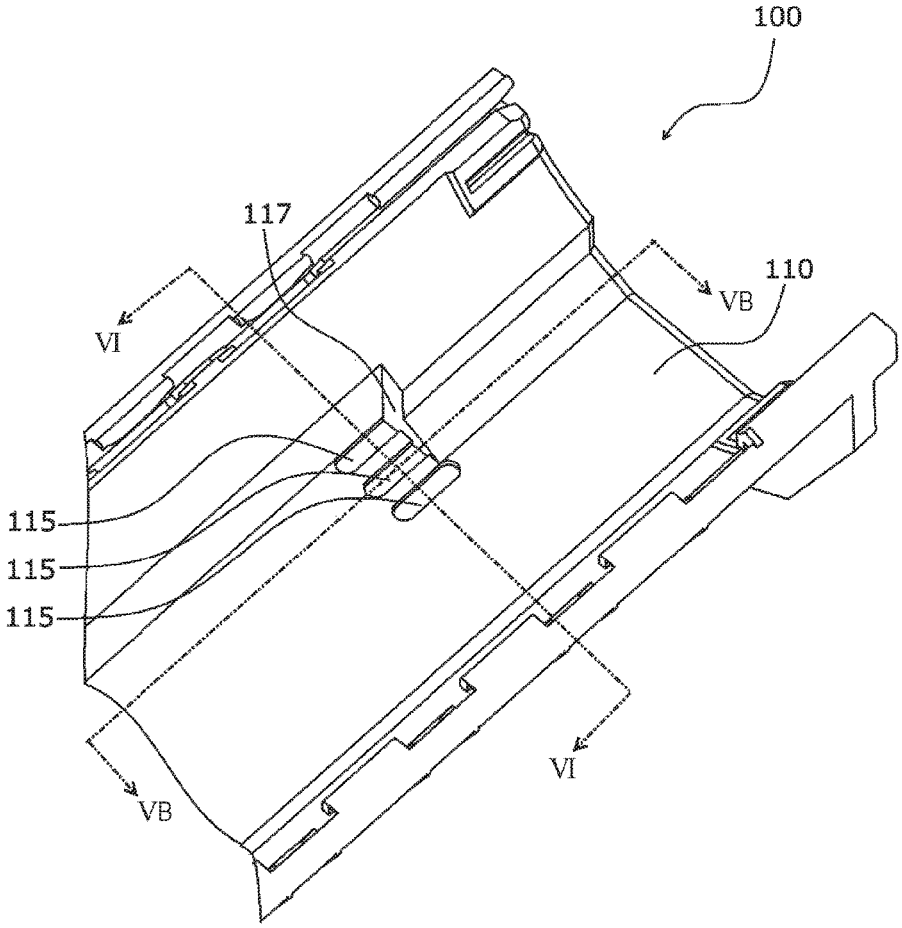
FIG. 4 is a perspective view of an end portion of the toner cartridge guide.
Figure 5A:
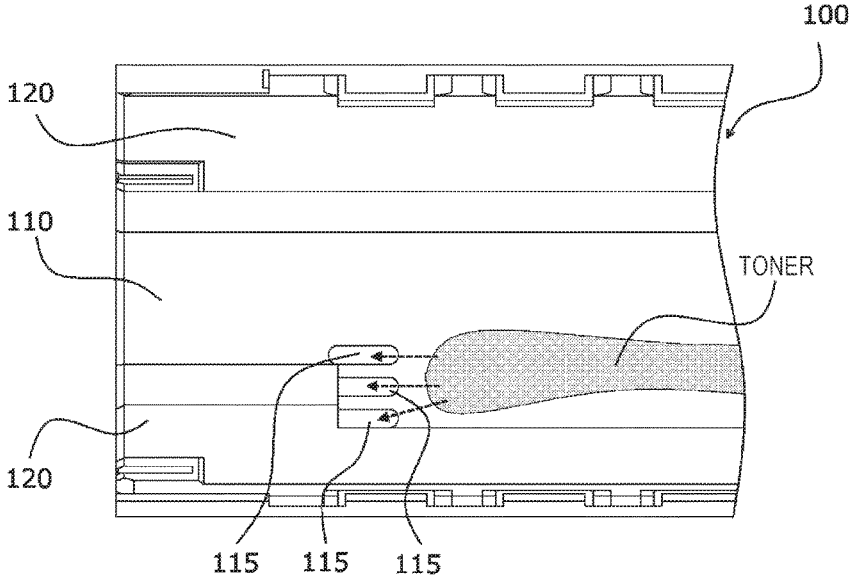
FIG. 5A is a plan view of an end portion of the toner cartridge guide.
Figure 5B:
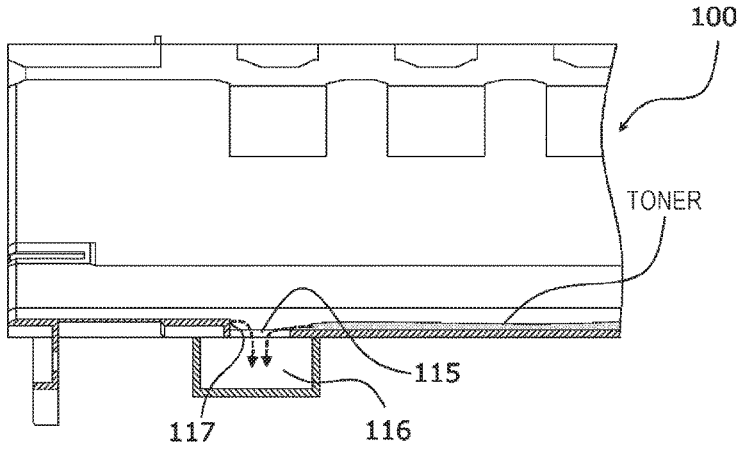
FIG. 5B is a sectional view of the end portion of the toner cartridge guide taken along line VB-VB in FIG. 4.
Figure 6:
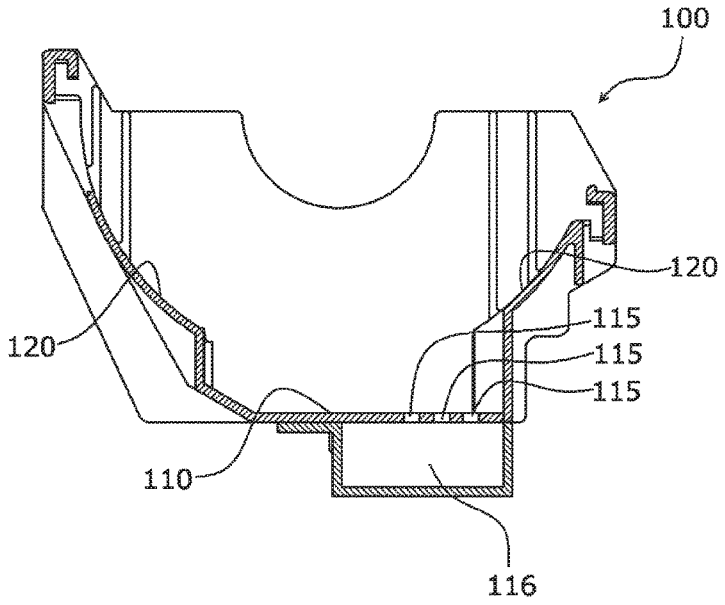
FIG. 6 is a sectional view of the end portion of the toner cartridge guide taken along line VI-VI in FIG. 4.

FIG. 2 is a vertical-sectional schematic diagram of the photoconductor unit 13, the developing device 14, and the toner cartridge T. FIG. 3 is a perspective view of insertion or removal of the toner cartridge T into or from a toner cartridge guide 100. FIG. 4 is a perspective view of an end portion of the toner cartridge guide 100. FIG. 5A is a plan view of an end portion of the toner cartridge guide 100, and FIG. 5B is a sectional view of the end portion of the toner cartridge guide 100 taken along line VB-VB in FIG. 4. FIG. 6 is a sectional view of the end portion of the toner cartridge guide 100 taken along line VI-VI in FIG. 4.

The structure of the toner cartridge guide 100 and insertion and removal of the toner cartridge T are described below with reference to the drawings.

(2.1) Developing Device

The developing device 14 includes a development roller 42 rotatably supported by the development housing 41. The development roller 42 faces the outer circumferential surface of the photoconductor drum 31 through an opening 41*a* of the development housing 41.

The development housing 41 is filled with the developer G, which is fed from the toner cartridge T to the development roller 42. The developer G fed to the development roller 42 is held in the form of a magnetic brush, and transported and fed to the electrostatic latent image on the photoconductor drum 31 with the rotation of the development roller 42.

A through hole 47, through which the developer G fed from the toner cartridge T passes, is formed at an upper end portion of the development housing 41 (on the far side of the image forming apparatus) to receive the developer G from an outlet of the toner cartridge T.

(2.2) Toner Cartridge Guide

As illustrated in FIG. 3, the entirety of the toner cartridge guide 100, which is an example of a removable-body receivable member, is an insertion-removal guide for the toner cartridge T, the guide being shaped to correspond to the cross-sectional shape of the toner cartridge T and extending from the near side to the far side when installed in the image forming apparatus 1.

The toner cartridge guide 100 includes a bottom surface portion 110, which guides and supports insertion and removal of the toner cartridge T, and side walls 120, which guide the outer circumferential surface of the toner cartridge T.

The toner cartridge guide 100 includes, at a far portion of the bottom surface portion 110 in an insertion/removal direction in which the toner cartridge T is inserted into or removed from the toner cartridge guide 100, a latch mechanism 111 and a feed port 112. Here, the far portion of the bottom surface portion 110 in the insertion/removal direction is the portion located further from an operator than the other portion when the operator inserts or removes the toner cartridge T into or from the toner cartridge guide 100. The latch mechanism 111 is engaged with the inserted toner cartridge T to hold the toner cartridge T. The feed port 112 receives the developer G discharged from the toner cartridge T.

The toner cartridge guide 100 includes openings 115 at a near portion (end portion) of the bottom surface portion 110 in the insertion/removal direction in which the toner cartridge T is inserted into or removed from the toner cartridge guide 100. Here, the near portion of the bottom surface portion 110 in the insertion/removal direction is the portion located nearer to an operator than the other portion when the operator inserts or removes the toner cartridge T into or from the toner cartridge guide 100.

In FIG. 3, the toner cartridge T, which is to be inserted into and removed from the toner cartridge guide 100, is vertically reversed to show a shutter member S, which covers an outlet (not illustrated) through which the developer G is discharged. When the toner cartridge T is detached from the image forming apparatus 1, as schematically illustrated with dots in FIG. 3, toner adheres to a portion around the shutter member S of the toner cartridge T when the shutter member S covers the outlet.

Toner adhering to the portion around the shutter member S adheres to the bottom surface portion 110 when the toner cartridge T moves along the bottom surface portion 110 of the toner cartridge guide 100. The amount of toner adhering to the bottom surface portion 110 after one insertion and removal of the toner cartridge T is small. However, repeated detachment gradually increases the amount of toner adhering to and accumulated in the bottom surface portion 110 (see dots in FIG. 3).

The toner accumulated in the bottom surface portion 110 is dragged in the insertion/removal direction with the movement (detachment) of the toner cartridge T, and falls to the outside from an end portion of the toner cartridge guide 100 to cause a toner stain.

As illustrated in FIG. 4 and FIG. 5A, the toner cartridge guide 100 according to the present exemplary embodiment has three openings 115 at an end portion of the bottom surface portion 110. The openings 115 are long holes extending in the insertion/removal direction of the toner cartridge T that is to be attached or detached. As illustrated in FIG. 5B, a reclaim container 116 is disposed below the openings 115. The reclaim container 116 is an example of a container member that is connected to the openings 115 to receive the toner.

A partitioning wall 117 is disposed at a near end portion of the openings 115 in the insertion/removal direction of the toner cartridge T. The partitioning wall 117 stands erect from the bottom surface portion 110 in a direction crossing (perpendicular to) the insertion/removal direction of the toner cartridge T.

As described above, the toner cartridge guide 100 has the openings 115, having a long hole shape, at the end portion of the bottom surface portion 110. Thus, a part of toner adhering to the bottom surface portion 110 and dragged in accordance with the movement (detachment) of the toner cartridge T directly falls into the reclaim container 116 through the openings 115 (see arrows in FIG. 5A). Another part of the toner is scratched off by the partitioning wall 117 and falls into the reclaim container 116 through the openings 115 (see arrows in FIG. 5B). This structure prevents toner that has leaked out during insertion and removal of the toner cartridge T from leaking to the outside of the apparatus.

Modified Example

Figure 7A:
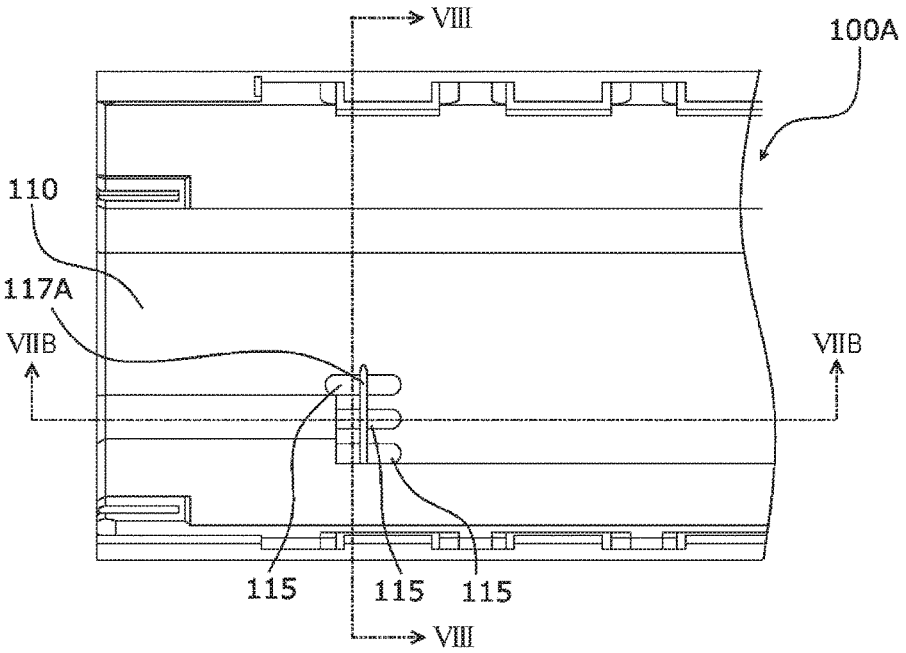
FIG. 7A is a plan view of an end portion of a toner cartridge guide according to a modified example.
Figure 7B:
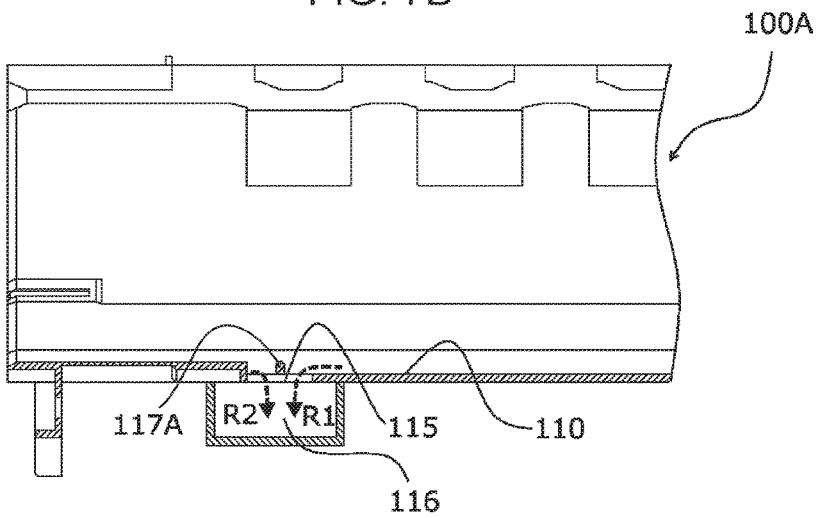
FIG. 7B is a sectional view of the end portion of the toner cartridge guide taken along line VIIB-VIIB in FIG. 7A.
Figure 8:
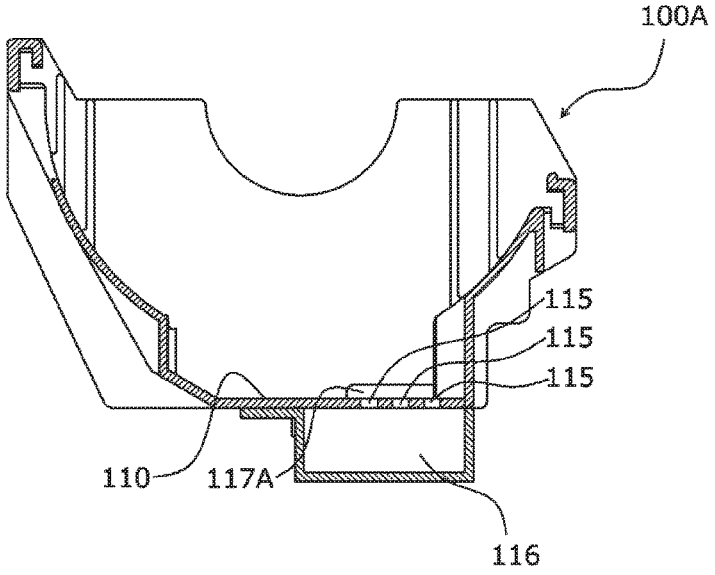
FIG. 8 is a sectional view of the end portion of the toner cartridge guide taken along line VIII-VIII in FIG. 7A.

FIG. 7A is a plan view of an end portion of a toner cartridge guide 100A according to a modified example, and FIG. 7B is a sectional view of the end portion of the toner cartridge guide 100A taken along line VIIB-VIIB in FIG. 7A. FIG. 8 is a sectional view of the end portion of the toner cartridge guide 100A taken along line VIII-VIII in FIG. 7A.

The toner cartridge guide 100A according to the modified example includes three openings 115 arranged side by side in the direction crossing the insertion/removal direction of the toner cartridge T. As illustrated in FIGS. 7A, 7B, and 8, the toner cartridge guide 100A includes a partitioning wall 117A, which extends across the three long holes at the middle of the openings 115 and protrudes toward the attached toner cartridge T.

In the toner cartridge guide 100A including the above partitioning wall 117A, the toner adhering to the bottom surface portion 110 and dragged in accordance with the movement (detachment) of the toner cartridge T is scratched off by the partitioning wall 117A and falls into the reclaim container 116 through the openings 115 (see arrow R1 in FIG. 7B).

When the toner cartridge T detached once is inserted into the toner cartridge guide 100A again, toner dragged by the toner cartridge T toward the far side of the bottom surface portion 110 (in the insertion direction) is scratched off by the partitioning wall 117A, and falls into the reclaim container 116 through the openings 115 (see arrow R2 in FIG. 7B).

This structure more efficiently prevents toner that has leaked out during insertion or removal of the toner cartridge T from leaking to the outside of the apparatus than a structure not including the partitioning wall 117A at the middle of the openings 115.

Second Exemplary Embodiment

Figure 9:
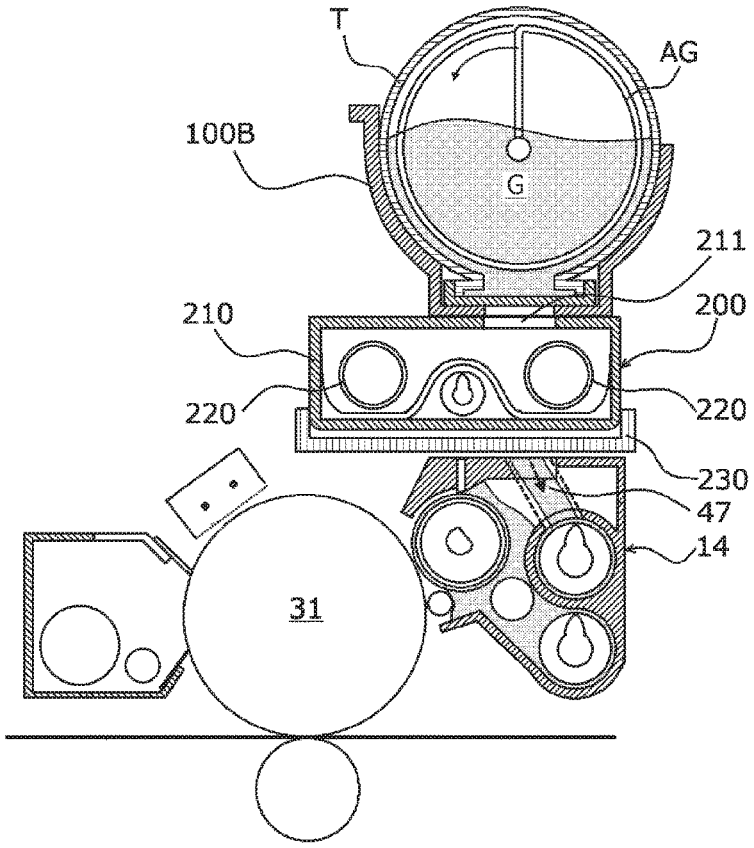
FIG. 9 is a vertical-sectional schematic diagram of a photoconductor unit, a developing device, a developer feeder, and a toner cartridge according to a second exemplary embodiment.
Figure 10:
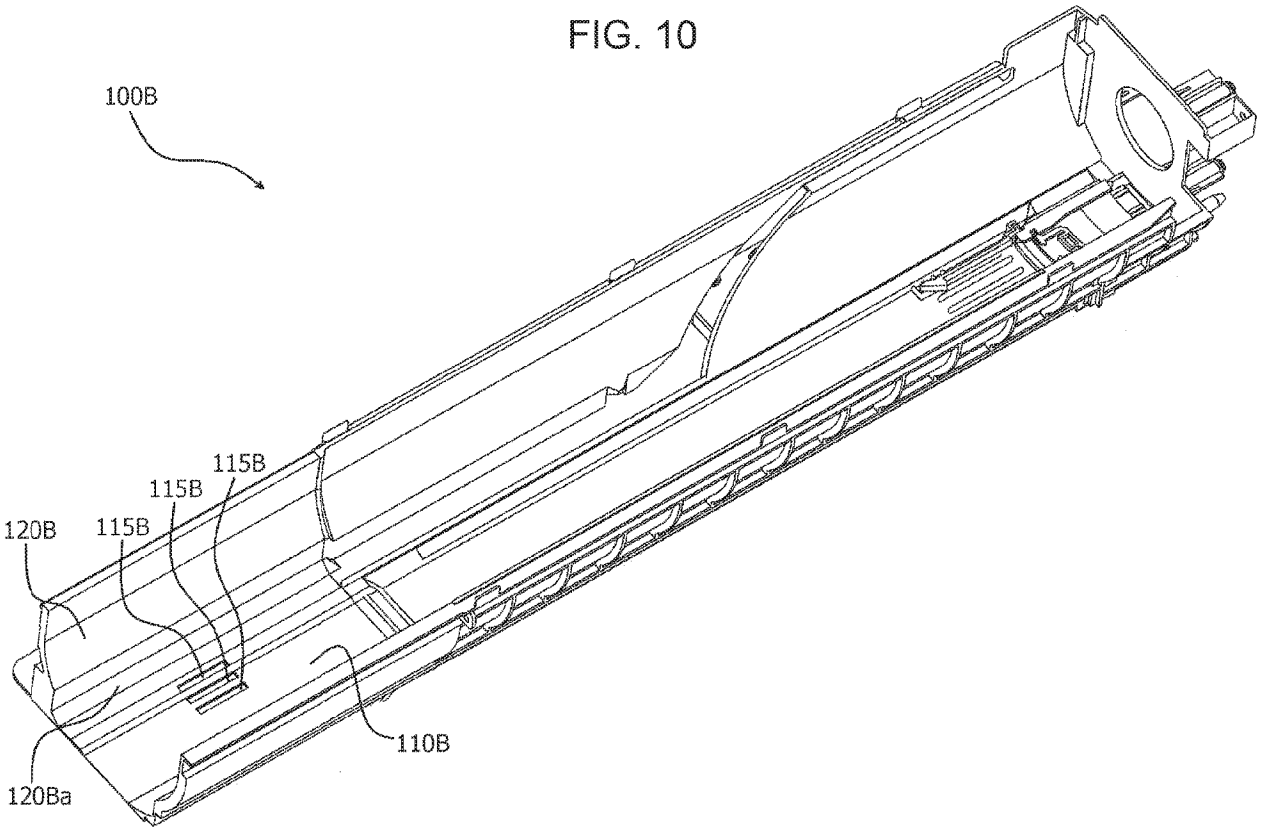
FIG. 10 is a perspective view of a toner cartridge guide according to the second exemplary embodiment.
Figure 11:
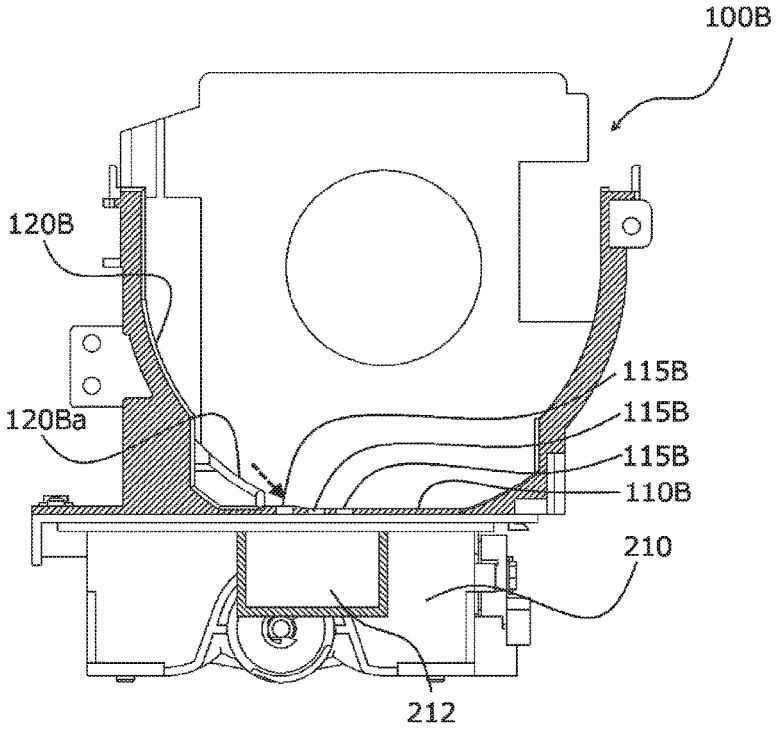
FIG. 11 is a cross-sectional schematic diagram of the toner cartridge guide and a developer feeder according to the second exemplary embodiment.

FIG. 9 is a vertical-sectional schematic diagram of the photoconductor unit 13, the developing device 14, a developer feeder 200, and the toner cartridge T according to the present exemplary embodiment. FIG. 10 is a perspective view of a toner cartridge guide 100B. FIG. 11 is a cross-sectional schematic diagram of the toner cartridge guide 100B and the developer feeder 200.

The structure and the operation of the toner cartridge guide 100B in an image forming apparatus 1A including the developer feeder 200 are described below with reference to the drawings. Components the same as those of the image forming apparatus 1 according to the first exemplary embodiment are denoted with the same reference signs and not described in detail.

As illustrated in FIG. 9, the developer feeder 200, which is an example of a container member, includes a container body 210, which receives the developer G filled in the toner cartridge T and contains the developer G, and transport augers 220, rotatably disposed in the container body 210 to transport the developer G by rotating.

The container body 210 includes a feed port 211 at an end portion. The feed port 211 receives the developer G discharged from the toner cartridge T. The container body 210 contains the developer G. The container body 210 includes an outlet (not illustrated) at an end portion. The outlet is connected to the through hole 47 of the developing device 14 to feed the contained developer G to the developing device 14.

As illustrated in FIG. 10, the toner cartridge guide 100B includes openings 115B at the near portion (end portion) of a bottom surface portion 110B in the insertion or removal direction of the toner cartridge T. As illustrated in FIG. 11, the three openings 115B are formed as long holes extending in the insertion/removal direction of the toner cartridge T at a lower end of a slope portion 120Ba of one side wall 120B, which guides the outer circumferential surface of the toner cartridge T, the slope portion 120Ba obliquely extending in a direction crossing the insertion/removal direction of the toner cartridge T.

As illustrated in FIG. 11, the container body 210 includes a reclaim container 212, which is an example of a container member disposed below the openings 115B formed in the bottom surface portion 110B of the toner cartridge guide 100B.

A part of the toner adhering to the bottom surface portion 110B and dragged with the movement (detachment) of the toner cartridge T falls into the reclaim container 212 through the openings 115B. In addition, toner that has leaked out during insertion or removal of the toner cartridge T is guided to the openings 115B along the slope portion 120Ba (see arrow in FIG. 11). Thus, the toner that has leaked out during insertion or removal of the toner cartridge T is prevented from leaking to the outside of the apparatus.

Modified Example

Figure 12:
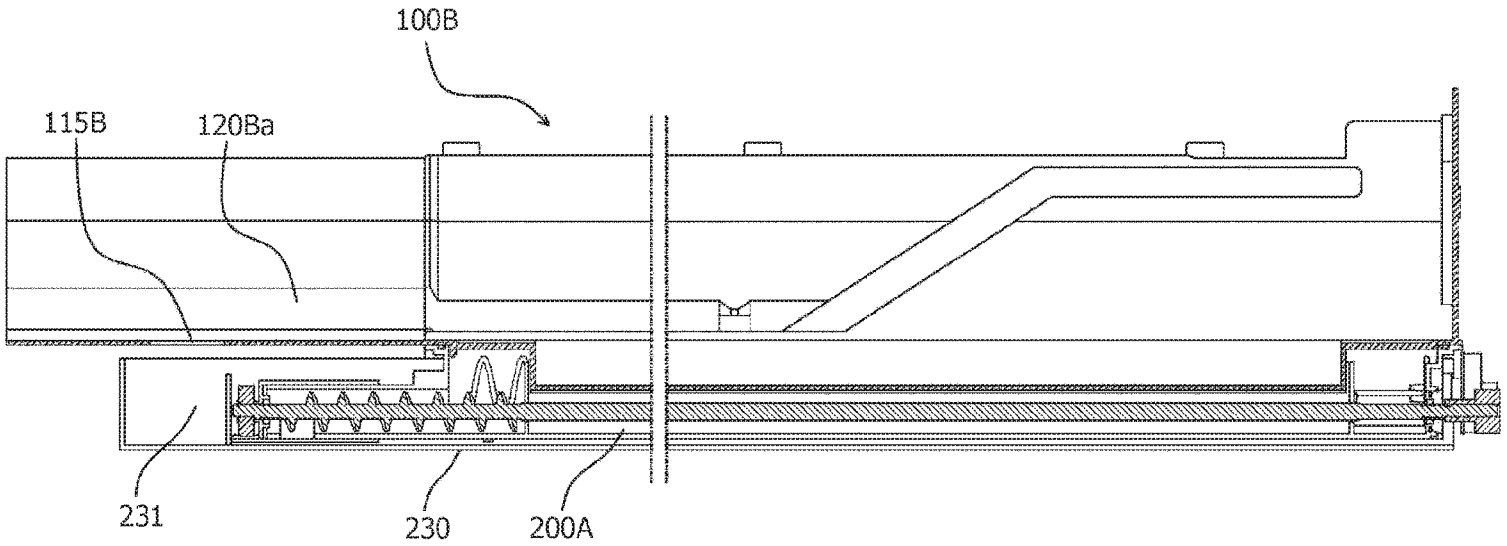
FIG. 12 is a vertical-sectional schematic diagram of a developer feeder and a toner cartridge guide according to a modified example of the second exemplary embodiment.

FIG. 12 is a vertical-sectional schematic diagram of the toner cartridge guide 100B and a developer feeder 200A according to a modified example.

The developer feeder 200A according to the modified example includes the container body 210 having the bottom side (near the developing device 14) covered by a thermal insulation covering 230, which is an example of a heat-blocking member. The thermal insulation covering 230 is detachable from the container body 210. The thermal insulation covering 230 blocks transmission of heat generated in the image forming unit 10 to the container body 210 containing the developer G to prevent adhesion of the developer G to the container body 210.

As illustrated in FIG. 12, the thermal insulation covering 230 extends to a portion below the openings 115B in the bottom surface portion 110B of the toner cartridge guide 100B to form a recovery portion 231, serving as an example of a container member.

Thus, the toner adhering to the bottom surface portion 110B and dragged with the movement (detachment) of the toner cartridge T falls into the recovery portion 231 of the thermal insulation covering 230 through the openings 115B. The thermal insulation covering 230, which is detachable from the container body 210, is allowed to be detached from the container body 210, as needed, for removal of the recovered toner.

Thus, the toner that has leaked out during insertion or removal of the toner cartridge T is prevented from leaking to the outside of the apparatus.

Thus far, specific examples are described as exemplary embodiments of the present invention. However, the technical scope of the present invention is not limited to the above exemplary embodiments. The exemplary embodiments may be changed in various manners within the scope not departing from the gist of the present invention.

For example, instead of the developer containing toner and a carrier, the present invention is applicable to a mono-component developer containing a magnetic toner, or a mono-component developer containing a nonmagnetic toner. Besides an image forming apparatus for color printing, an image forming apparatus for monochrome printing may be used as the image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a removable-body receivable member that removably supports a removable body containing a developer, the removable-body receivable member having a feed port and an opening; and a reclaim container member connected to the opening to contain the developer, wherein the feed port is located on the front side of an insertion direction in which the removable body is configured to be inserted into the removable-body receivable member, and the opening is located on a rear side of the removable-body receivable member with respect to the insertion direction.

2. The image forming apparatus according to claim 1, wherein the opening is at least one long hole extending in the insertion direction of the removable body.

3. The image forming apparatus according to claim 1, wherein the at least one long hole includes a plurality of long holes arranged in a direction crossing the insertion direction of the removable body, wherein a partitioning wall extends across the plurality of long holes and protrudes toward the removable body attached to the removable-body receivable member.

4. The image forming apparatus according to claim 3, wherein the partitioning wall is disposed at middle portions of the plurality of long holes in the insertion direction of the removable body.

5. The image forming apparatus according to claim 3, wherein the partitioning wall is disposed at front end portions of the plurality of long holes in the insertion direction of the removable body.

6. The image forming apparatus according to claim 1, wherein the removable-body receivable member includes a guide surface that guides insertion or removal of the removable body, and the opening is formed at a lower end portion of a slope portion of the guide surface, the slope portion obliquely extending in a direction crossing the insertion direction of the removable body.

7. The image forming apparatus according to claim 1, comprising a container body that receives the developer housed in the removable body to contain the developer, and that has a feed port through which the developer contained in the container body is to be fed to a developing device, wherein the container member is detachably attached to the container body.

8. The image forming apparatus according to claim 1, comprising:

a heat-blocking member detachably disposed at a portion between an image forming apparatus body and the removable-body receivable member, wherein the container member is disposed at an end portion of the heat-blocking member.

9. An image forming apparatus, comprising:

a removable-body receivable member that removably supports a removable body containing a developer, the removable-body receivable member having an opening at a near portion in an insertion/removal direction in which the removable body is inserted into or removed from the removable-body receivable member; and a reclaim container member connected to the opening to contain the developer, wherein the at least one long hole includes a plurality of long holes arranged in a direction crossing the insertion/removal direction of the removable body, wherein a partitioning wall extends across the plurality of long holes and protrudes toward the removable body attached to the removable-body receivable member.

10. The image forming apparatus according to claim 9, wherein the partitioning wall is disposed at middle portions of the plurality of long holes in the insertion/removal direction of the removable body.

11. The image forming apparatus according to claim 9, wherein the partitioning wall is disposed at front end portions of the plurality of long holes in the insertion/removal direction of the removable body.

12. An image forming apparatus, comprising:

a removable-body receivable member that removably supports a removable body containing a developer, the removable-body receivable member having an opening at a near portion in an insertion/removal direction in which the removable body is inserted into or removed from the removable-body receivable member;

a container member connected to the opening to contain the developer; and a heat-blocking member detachably disposed at a portion between an image forming apparatus body and the removable-body receivable member, wherein the container member is disposed at an end portion of the heat-blocking member.

13. The image forming apparatus according to claim 1, wherein the opening is separate from the feed port.

* * * * *